US011562647B2

(12) United States Patent
Nguyen

(10) Patent No.: US 11,562,647 B2
(45) Date of Patent: Jan. 24, 2023

(54) DYNAMIC VIRTUAL VEHICLE DETECTION AND ADAPTIVE TRAFFIC MANAGEMENT SYSTEM

(71) Applicant: THRUGREEN, LLC, Falls Church, VA (US)

(72) Inventor: David H Nguyen, Southbridge, VA (US)

(73) Assignee: ThruGreen, LLC, Falls Church, VA (US)

( * ) Notice: Subject to any disclaimer, the term of this patent is extended or adjusted under 35 U.S.C. 154(b) by 0 days.

(21) Appl. No.: 17/049,375

(22) PCT Filed: Apr. 22, 2019

(86) PCT No.: PCT/US2019/028440

§ 371 (c)(1),
(2) Date: Oct. 21, 2020

(87) PCT Pub. No.: WO2019/204801

PCT Pub. Date: Oct. 24, 2019

(65) Prior Publication Data

US 2021/0248904 A1 Aug. 12, 2021

Related U.S. Application Data

(60) Provisional application No. 62/765,280, filed on Aug. 31, 2018, provisional application No. 62/660,940, filed on Apr. 21, 2018.

(51) Int. Cl.

| | |
|---|---|
| ***G08G 1/087*** | (2006.01) |
| ***G08G 1/08*** | (2006.01) |
| ***G08G 1/01*** | (2006.01) |
| ***G08G 1/052*** | (2006.01) |
| ***G08G 1/056*** | (2006.01) |

(52) U.S. Cl.

CPC ..... *G08G 1/08* (2013.01); *G08G 1/012* (2013.01); *G08G 1/052* (2013.01); *G08G 1/056* (2013.01); *G08G 1/087* (2013.01)

(58) Field of Classification Search

CPC ..... G08G 1/012; G08G 1/08; G08G 1/087
See application file for complete search history.

(56) References Cited

U.S. PATENT DOCUMENTS 9,595,193 B1 * 3/2017 Duale ..... G08G 1/0116
9,805,595 B1 * 10/2017 Liebinger Portela .. G08G 1/012
(Continued)

*Primary Examiner* — Andrew W Bee
(74) *Attorney, Agent, or Firm* — Laubscher & Laubscher PC

(57) ABSTRACT

A traffic detection device for sending a call signal to a traffic signal controller, the traffic detection device having a receiver to receive information sent from a mobile device, the information including identity information and/or location information of the mobile device, a traffic control device (TCD) interface to connect the traffic detection device to the traffic signal controller, and a processor to define a dynamic approach based on one or more of the identity information, speed limit, time of day, or speed of the mobile device. The device may determine whether to send a calf signal to the traffic signal controller via the TCD interface to prompt the traffic signal controller, when the processor determines that the mobile device is in the dynamic approach.

15 Claims, 10 Drawing Sheets

(56) References Cited

U.S. PATENT DOCUMENTS

| | | | | |
|---|---|---|---|---|
| 2011/0304476 | A1* | 12/2011 | Johnson | G08G 1/087 340/906 |
| 2015/0243165 | A1* | 8/2015 | Elsheemy | G08G 1/096775 340/906 |
| 2017/0132915 | A1* | 5/2017 | Cross | H04W 4/027 |
| 2017/0186315 | A1* | 6/2017 | Glasgow | G08G 1/096883 |

* cited by examiner

DYNAMIC VIRTUAL VEHICLE DETECTION AND ADAPTIVE TRAFFIC MANAGEMENT SYSTEM

This application claims benefit of U.S. non-provisional application Ser. No. 15/847,351 and provisional applications 62/660,940 and 62/765,280, the contents of which are incorporated herein in their entirety.

BACKGROUND

Field of the Disclosure

The present disclosure is directed to a dynamic virtual vehicle detection and adaptive vehicle traffic management system.

Description of the Related Art

Vehicle traffic congestion is a major problem worldwide with costs estimated in the hundreds of billions of dollars per year in the United States alone. While there are many causes of traffic congestion, one of the major causes is traffic signal control systems operating with limited information with respect to the road and traffic conditions, and therefore unable to accurately match traffic signal operations with actual traffic movements of vehicles, bicyclists, and pedestrians.

Congestion can arise in cases where more vehicles are waiting in a queue at a junction for a traffic signal to change from displaying a red light to displaying a green light, and the period the traffic signal is green does not allow all the vehicles waiting in the queue to pass through the junction. Another case where congestion may arise in a similar scenario is if the traffic signal does remain green to otherwise clear the waiting queue of vehicles but a road ahead of the queue of vehicles is congested with other vehicles, the queue of vehicles still cannot proceed through the junction.

SUMMARY

The present disclosure is directed to a system for a traffic detection device for sending a call signal to a traffic signal controller, the traffic detection device having a receiver configured to receive information sent from a mobile device, and an individual, the information including one or more identity information and location information, a traffic control device (TCD) interface configured to connect the traffic detection device to the traffic signal controller, and a processor. The processor is configured to determine a dynamic approach based on at least one of the identity information, a speed limit, a time of day, and a speed, determined based on the location information whether the mobile device is in the dynamic approach, and then to send the call signal to the traffic signal controller via the TCD interface. The call signal is for prompting an action of the traffic signal controller, when the processor determines that the mobile device is in the dynamic approach.

The foregoing general description of the illustrative implementations and the following detailed description thereof are merely exemplary aspects of the teachings of this disclosure, and are not restrictive.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings wherein:

FIGS. 2E-1 and 2E-2 are block diagrams illustrating exemplary configurations of a TCD 340;

DETAILED DESCRIPTION OF THE EMBODIMENTS

Figure 1:
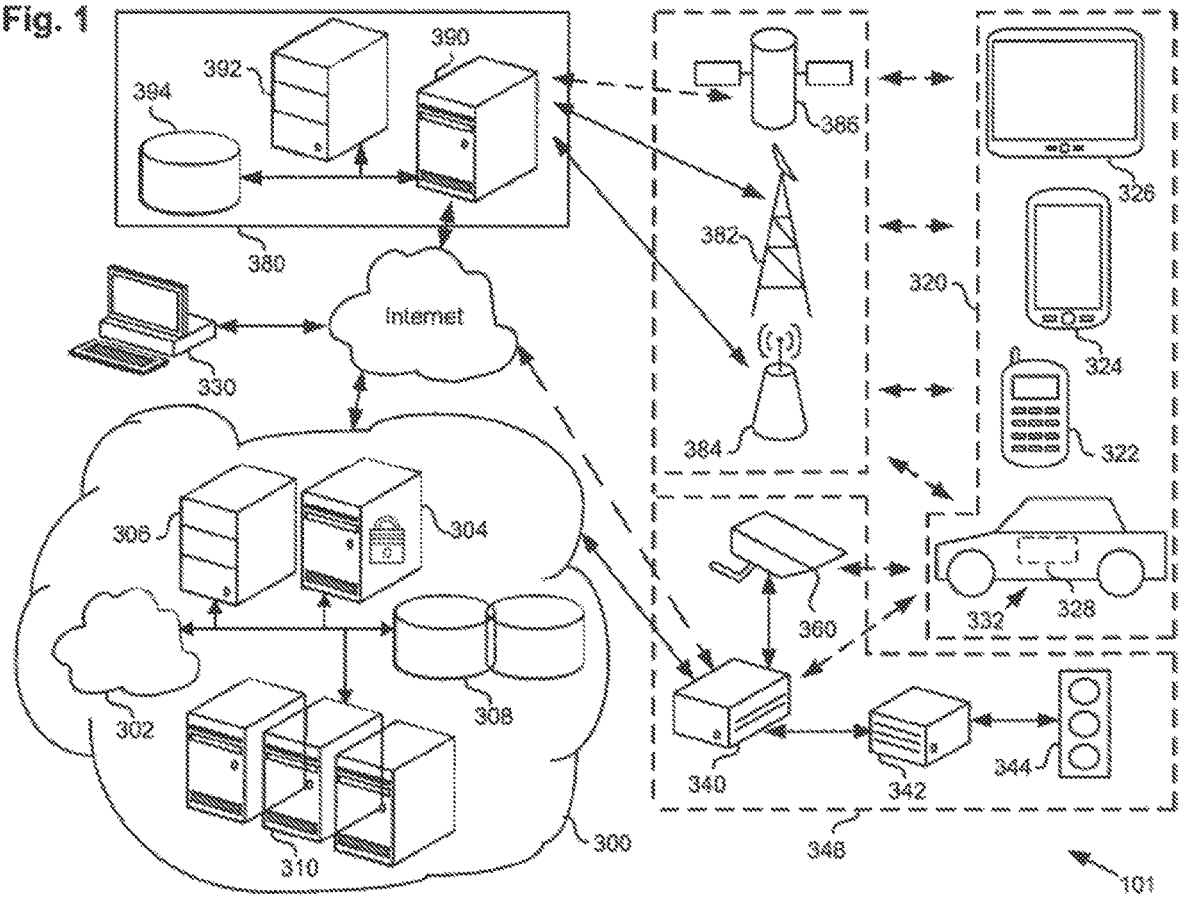
FIG. 1 illustrates a traffic management system (TMS) 101, including a computing network environment and connections between various systems and devices, according to one example.

In the drawings, like reference numerals designate identical or corresponding parts throughout the several views. Further, as used herein, the words "a", "an" and the like generally carry the meaning of "one or more", unless stated otherwise. Referring now to the drawings, wherein like reference numerals designate identical or corresponding parts throughout the several views.

References herein to the mobile device 320 may also be interchangeable with references to a motor vehicle 332 ("vehicle"), a bicycle, or other vehicle carrying a mobile device, or having and using built-in features of a mobile device, such as location, communication, sensing, and/or computing capabilities. References to a green light, a yellow light, and a red light are interchangeable with a green traffic signal, a yellow traffic signal, and a red traffic signal, respectively. Note figures may not be drawn to scale.

FIG. 1 illustrates a traffic management system (TMS) 101, including a computing network environment and connections between various systems and devices, according to one example. A mobile device 320 or a vehicle 332 may be configured, such as with an app, to provide location information (GPS, GLONASS, etc.) of the mobile device 320 and/or the vehicle 332 to a traffic management system (TMS) 101 such as a server, cloud or fog network, in real-time or near real-time, which may include a traffic signal system (TSS) 348. The TSS 348 may be configured as part of or to communicate with a TMS 101. Information, including a location of the mobile device 320 and/or the vehicle 332, may be analyzed by the TMS 101.

The computing network environment may be concentrated in a physical location or distributed, such as by a cloud computing environment 300 and/or a fog computing environment. In one embodiment, users and devices may access the cloud computing environment 300 through systems, mobile devices 320, and fixed devices that are connected to an internet, other networks or, for example, directly with the cloud computing environment 300, a Traffic Control Device (TCD) 340, or a detection device 360. Connections to the internet may include both wireless and wired connections.

Exemplary mobile devices 320 may include a cell phone 322, a smartphone 324, a tablet computer 326, and a variety of connected vehicle systems 328, such as telematics devices, navigation and infotainment devices, and vehicle tracking devices that may be on-board, built-into, or installed in a vehicle 332. Additional mobile devices 320 may include identification, biometric, health, medical, and physiological monitoring devices, or any device that may provide data to a mobile device or network. Mobile devices 320 may also include devices such as laptop and notebook computers that may use wireless or mobile communication to communicate with the internet, mobile networks, or other wireless networks.

A mobile device 320 may connect to the cloud and the TCD 340 through a mobile network service 380, with signals transmitted to the mobile network service 380 (e.g. EnodeB, HeNB, or radio network controller) via a wireless communication channel such as a base station 382 (e.g. a 3G, 4G, 5G, EDGE, or LTE network), an access point 384 (e.g., a femtocell or Wi-Fi network), a satellite connection 386, or any other wireless form of communication that is known. The TCD 340 may also be part of a traffic signal system (TSS) 348, as further illustrated by FIGS. 2A-2D.

Further, wireless communication may occur between a mobile device 320 and a TCD 340 or detection device 360, such as through Vehicle-to-Vehicle (V2V), Vehicle-to-Infrastructure (V2I), Vehicle-to-Person (V2P), and Vehicle-to-Everything (V2X) protocols, including use of Dedicated Short Range Communication (DSRC), which may be operating on a 5.9 GHz spectrum, Near Field Communication (NFC), Radio-frequency identification (RFID), infrared, the mobile device 320 and another mobile device, or any other form of wireless communication or detection that is known, if the detection device 360 or the TCD 340 is configured to communicate with the mobile device 320, or otherwise detect the vehicle 332 or the mobile device 320. In one example, the TCD 340 may communicate directly with the cloud computing environment 300 (and/or may be considered part of the cloud computing environment 300), the internet, and/or a mobile device 320, for example, to stream images from a traffic camera, transmit a road or travel condition, or communicate information to, from, or about the cloud computing environment 300, the TCD 340, or the detection device 360, or receive information from the mobile device 320. In some cases, the detection device 360 may connect directly to the internet and/or the mobile device 320 (such as via a roadside DSRC receiver/transmitter unit or via a local fog computing network).

In one example, signals from a wireless interface of the mobile device 320 and a wireless communication channel are transmitted to the mobile network service 380. A central processor 390 of the mobile network service 380 may receive requests and information via signals from one or more mobile device 320. The central processor 390 may be connected to a server 392 and a database 394, and the mobile network service 380 may, for example, provide authentication or authorization for access to the various devices and systems in communication with the mobile network service 380 and/or the mobile device 320 based on data stored in the database 394. Mobile device information or requests may then be delivered to the cloud computing environment 300 through at least one of the internet and another connection.

The cloud computing environment 300 may also be accessed through fixed devices such as a desktop terminal 330, the TCD 340, or the detection device 360 that is connected to the internet via a wired network connection or a wireless network connection.

The network may be a public or private network such as a Local Area Network (LAN) or a Wide Area Network (WAN). Further, the TCD 340 may be connected directly to the cloud computing environment 300, again either via a wired network connection or a wireless network connection. The network may be wireless such as a cellular network (including 3G, 4G, 5G, EDGE, and LTE systems). The wireless network may also be connected by Wi-Fi, Bluetooth, or any other wireless form of communication that is known. Mobile devices 320 and fixed devices may connect to the cloud computing environment 300 via the internet, or through another connection, to send input to and receive output from one or more of the cloud computing environment 300, the TCD 340, the detection device 360, or other fixed or mobile devices. Each mobile device 320 may communicate with at least one of the cloud computing environment 300, the TCD 340, another mobile device 320, and the detection device 360 through at least one of any form of wireless communication.

In some examples, the TCD 340 may be connected to a Conflict Monitoring Unit (CMU) 342, and the CMU 342 may be connected to a Traffic Control Device (TCD) 344 such that the CMU 342 verifies instructions provided by the TCD 340 to the TCD 344 are valid and safe to execute. In another example, the TCD 340 is connected to and directly controls the TCD 344. Examples of the TCD 344 may include traffic signals, dynamic message signs, speed limit signs, gates, railroad crossings, and dynamic lane indicators.

In one example, the cloud computing environment 300 may include a cloud controller 302 to process requests to provide devices with corresponding cloud services. These services may be provided through the use of a service-oriented architecture (SOA), utility computing, and virtualization.

In one example, the cloud computing environment 300 may be accessed via an access interface such as a secure gateway 304. The secure gateway 304 may, for example, provide security policy enforcement points placed between cloud service consumers and cloud service providers to apply enterprise security policies as the cloud-based resources are accessed. Further, the secure gateway 304 may consolidate multiple types of security policy enforcement, including, for example, authentication, authorization, single sign-on, tokenization, security token mapping, encryption, logging, alerting, and API control.

The cloud computing environment 300 may provide computational resources using a system of virtualization, wherein processing and memory requirements may be dynamically allocated and distributed among a combination of processors and memories to create a virtual machine to efficiently utilize available resources. Virtualization effectively may create an appearance of using a single, seamless computer even though multiple computational resources and memories may be utilized depending on fluctuations in demand.

In one example, virtualization is accomplished by use of a provisioning tool 306 that prepares and equips the cloud resources such as a data storage 308 and a processing center 310 to provide services to devices connected to the cloud computing environment 300. The processing center 310 can be a mainframe computer, a data center, a computer cluster, or a server farm. In one example, the data storage 308 and the processing center 310 are co-located.

The preceding descriptions are non-limiting examples of corresponding structure for performing the functionality described herein. One skilled in the art will recognize that the TCD may be adjusted or controlled by a computing device and/or a TCD controller in response to data from a mobile device or other detection or information input source in a variety of ways.

FIGS. 2A-2D are block diagrams illustrating exemplary configurations of traffic signal systems 348 (348*a*, 348*b*, etc.). Each traffic signal system 348 may be configured to provide communication and detection between at least one mobile device 320, the cloud computing environment 300, at least one TCD 340, and at least one detection device 360 to adaptively manage traffic control devices and/or systems.

One or more mobile devices 320 may be configured to communicate with at least one of the cloud computing environment 300, the TCD 340, and the detection device 360. The TCD 340 may be connected to the cloud computing environment 300, the detection device 360, and the mobile devices 320.

The TMS 101 may then provide a signal to the traffic signal system 348 to adapt the operation of traffic control devices such as traffic signals, gates, and dynamic message signs to be responsive to the presence and actions of the vehicle 332 and/or the mobile device 320.

In another case, a cloud computing environment 300 may communicate directly to a detector card (DC) 504 via a communication link, for example, a cellular modem, Ethernet connection, radio communication, or other digital receiver. Commands may be sent from the cloud computing environment 300 directly to the DC 504, which may further be connected to or part of a traffic controller device (TCD) 340. The DC 504 may in turn process and provide input, such as a detection call to a controller 506, which may also be part of the TCD 340 or the TSS 348 and may be configured to communicate with the DC 504.

The DC 504 may be a printed circuit board (PCB) configured to receive inputs from the cloud computing environment 300 or other computing environment such as a local device, fog, or mesh through the wireless connection, and process the signal and then, if necessary, provide input to the TCD 340 and/or controller 506.

In one case, the DC 504 includes a microprocessor to process the information received such as which channel of the controller 506 to send a detection call to (and when), using contact closures to open or close a circuit, providing an electrical signal to the controller 506 representing the direction of travel and through which a signal status of the traffic signal 344 may be changed or extended. The DC 504 may also be configured to receive inputs to the controller 506 from other sources, such as detector cards of fixed sensors located at the junction 5001, analog electrical signals, and other data sources that may be available. The DC 504 may also be configured to receive output data from the controller 506 that is sent to the traffic signals 344, allowing the DC 504 to provide traffic signal phase information to the and the cloud computing environment 300, TMS 101 and the mobile device 320.

In another case, the DC 504 may operate as described above while using a Serial Data Link Control (SDLC) connection with the controller 506 instead of contact closures. SDLC connections may allow the DC 504 to send as well as receive data from the controller 506 or other components within the TCD 340. Data received from the TCD 340 may include SPaT information as well as other data or status information from the TCD 340. Data received may be transmitted via the communication link to the cloud computing environment 300 or other destination.

In another case, instead of the cloud computing environment 300 or other external network communicating to the TCD 340, the TCD 340 may receive signals directly from a central traffic management system 359 that may or may not be distinct from the cloud computing environment 300.

In yet another case, the central traffic management system 359 may communicate directly to a Conflict Monitoring Unit (CMU)/Malfunction Management Unit (MMU) at a junction to actuate the traffic signal changes directly, based on signals the central traffic management unit 359 may receive from the cloud computing environment 300 or the mobile device 320 or the vehicle 332.

Figure 2A:
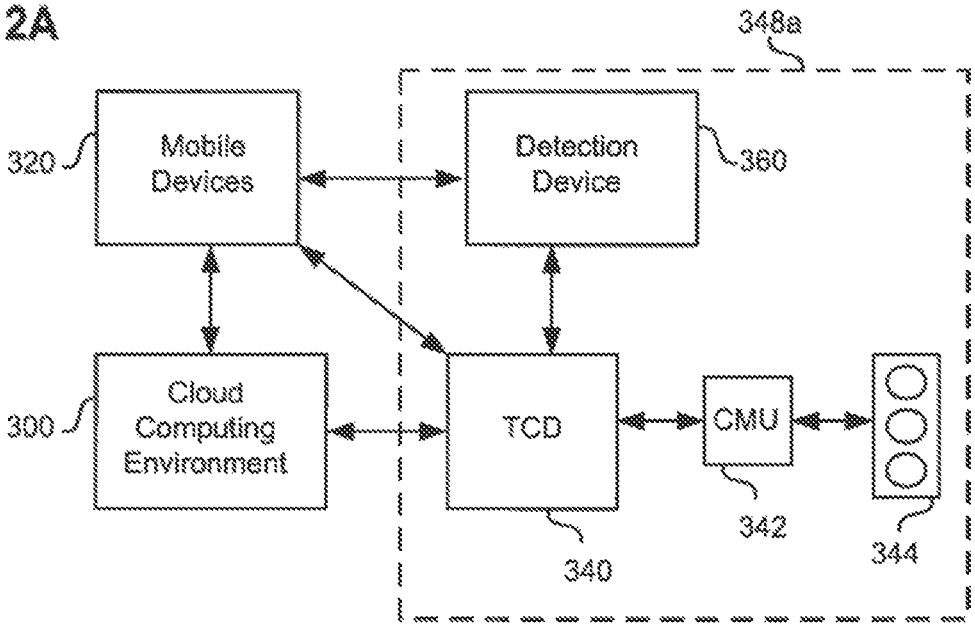
FIGS. 2A-2D are block diagrams illustrating exemplary configurations of traffic signal systems 348 (348*a*, 348*b*, etc.)
Figure 2B:
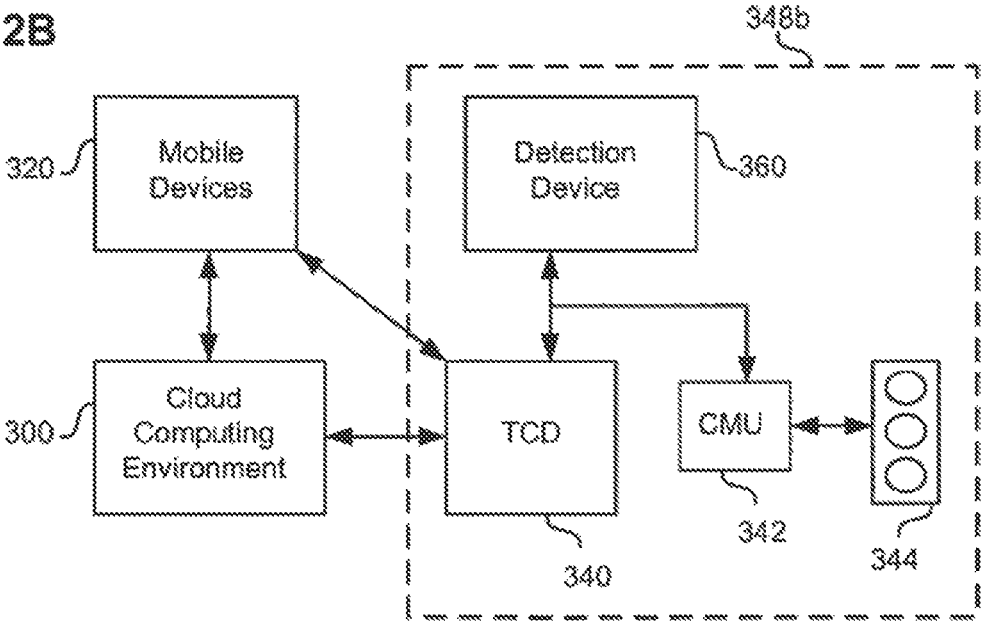
Figure 2C:
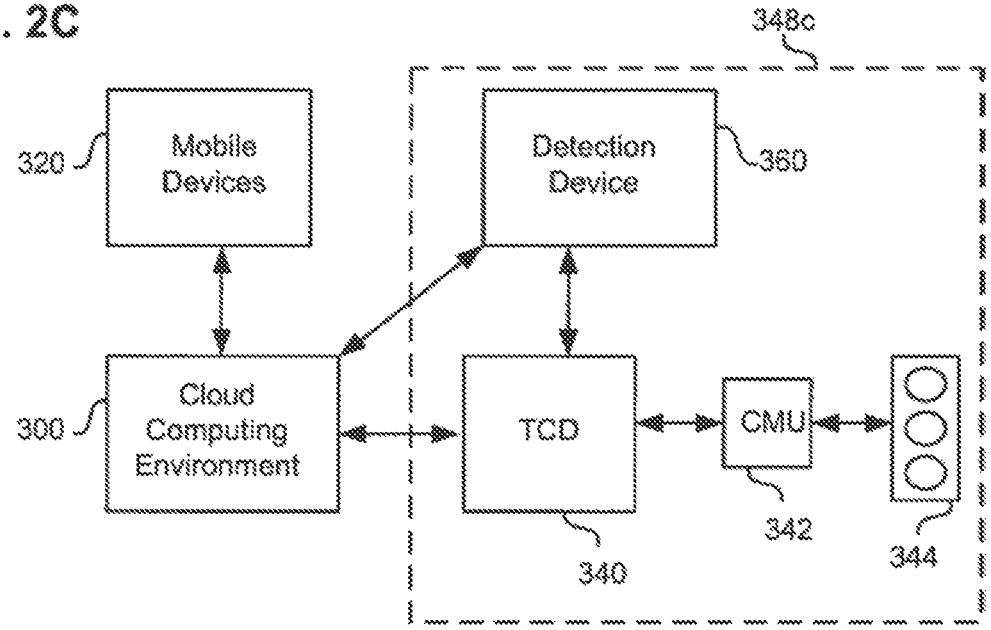
Figure 2D:
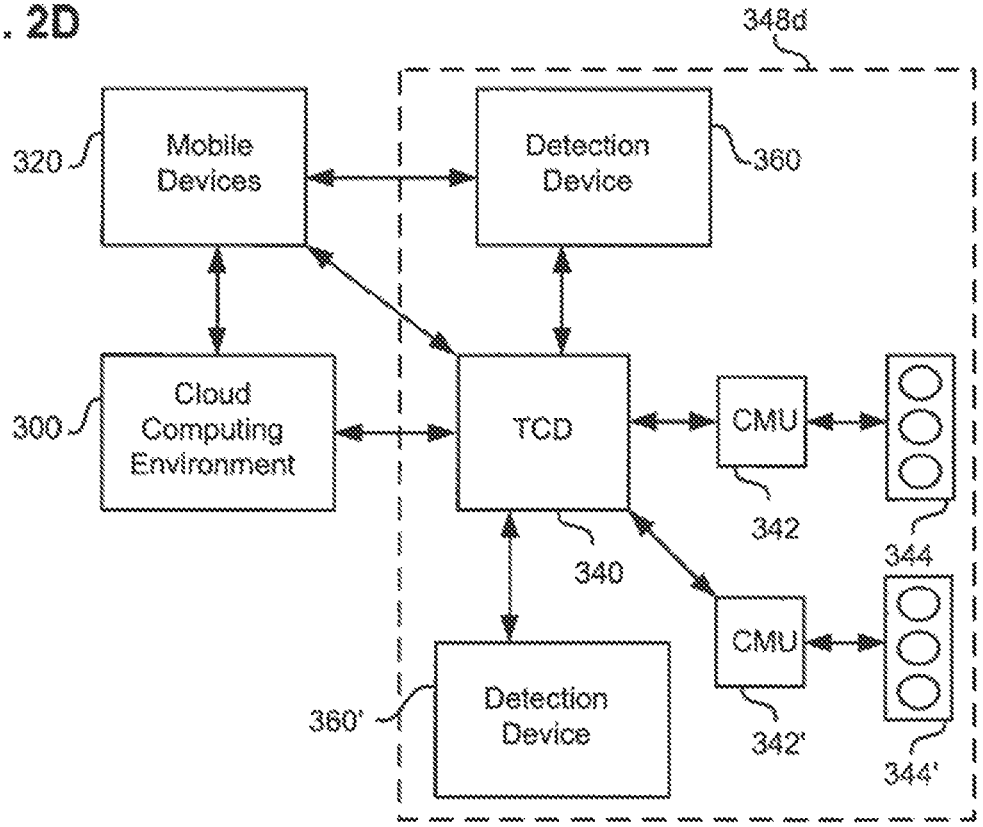
Figures 1, 2E:
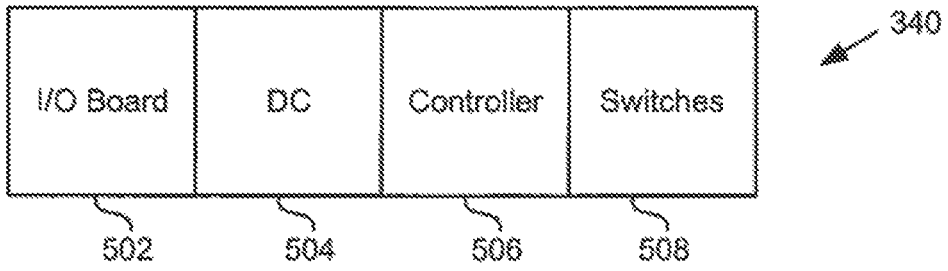
Figures 2, 2E:
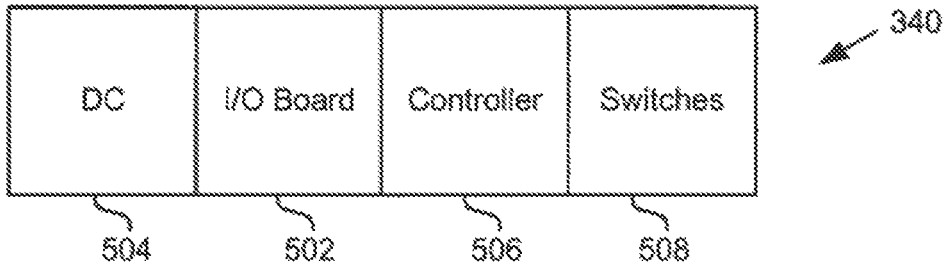

FIGS. 2E-1 and 2E-2 are block diagrams illustrating exemplary configurations of a TCD 340. In one example, the TCD 340 may include an input/output (I/O) interface 502, a DC 504, a (traffic signal controller) controller 506, and switches 508. The TCD 340 may be a portion of a TSS 348 and/or the TMS 101 and may be configured such that the DC 504 receives signals directly from the cloud computing environment 300 or a mobile device 320, or through an I/O interface 502. The I/O interface 502, such as a detector card rack, Bus Interface Unit (BIU), or other electrical panel or switchboard, may be configured to allow signals, voltages, or messages to be transmitted between specific channels or circuits to provide/allow specific inputs and/or outputs between the DC 504 and the controller 506. Descriptions herein may also describe the DC 504 communicating with the TMS 101 at large.

In another case, the DC 504 may also be configured to communicate with the controller 506, and may do so by way of an I/O interface 502 between them. The DC 504 may also communicate directly with the controller 506 if the DC 504 is wired directly to the controller 506. The controller 506 may output voltages to the switches 508 that operate the various phases of the TCD 344 (generally a traffic signal or traffic light). In some examples a conflict monitoring unit (CMU) 342 may be positioned between the controller 506 and the traffic signal 344 to verify that errors or provision of conflicting traffic signals are not simultaneously possible.

Figure 3A:
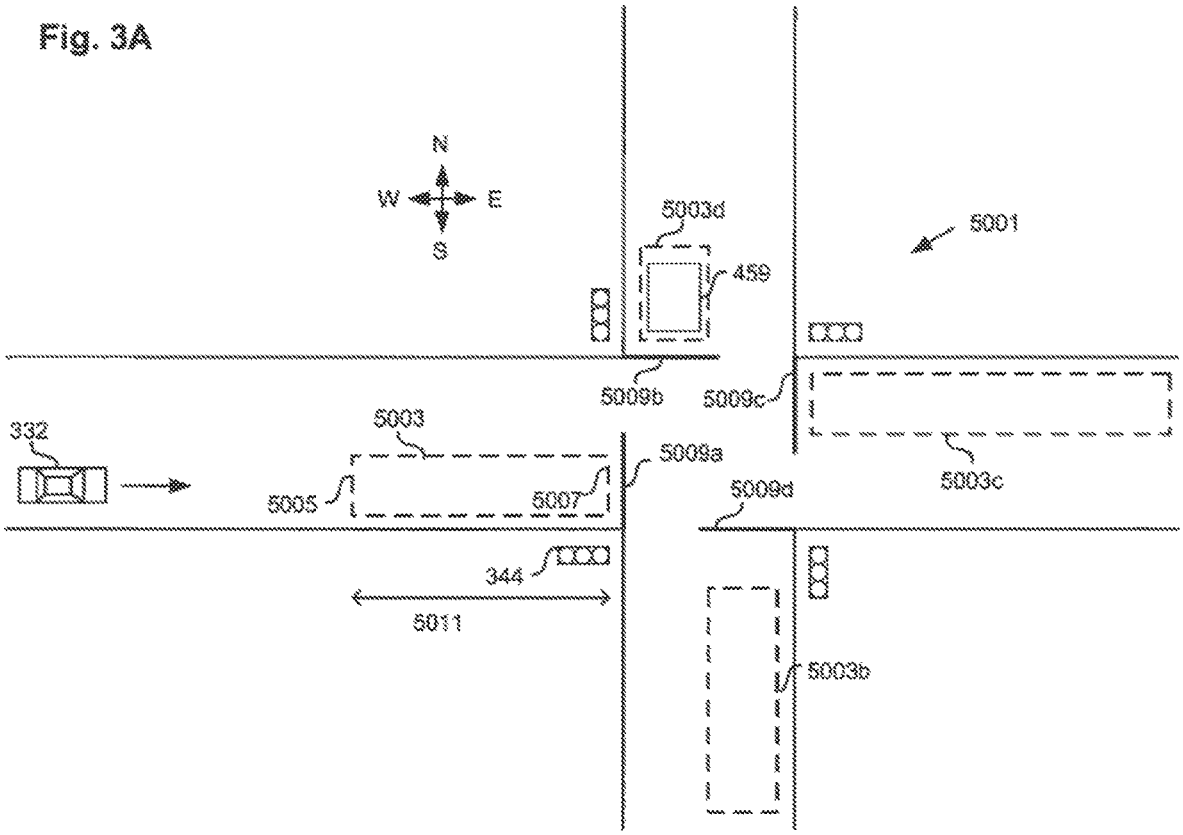
FIG. 3A is a diagram of a signalized four way junction 5001, according to one example.

FIG. 3A is a diagram of a signalized four way junction 5001, according to one example. The junction 5001 may be defined as an area where more than one road segment intersects, for example, an area approximately bordered by stop bars 5009 (5009*a*, 5009*b*, 5009*c*, 5009*d*). The junction 5001 may have a traffic signal 344 (FIGS. 2A-2D) in one or more directions of travel, each signal having red, yellow and green lights for one or more traffic phases of the junction 5001. The junction 5001 may have one or more approaches 5003 (5003, 5003*b*, 5003*c*, 5003*d*). Each approach 5003 may be a defined area, such as by GPS coordinates or other locating system, and referenced by a TMS 101 to determine whether a mobile device 320 is located within the approach 5003. Location coordinates and other geometric (such as the number of intersecting road segments) and configuration information of the junction 5001 may also be known to the TMS 101.

Approaches may be defined virtually by polygons of varying shapes, for example a rectangle or curved sector, to mathematically approximate an area of a segment of an actual road, path, or walkway that may be linear, curved or otherwise non-linear. A border of the approach 5003 may be referred to as a start 5005 or as an end 5007 based on geometry and traffic direction of the segment of road where the approach 5003 is located, and where a vehicle 332 is likely to cross into or out of the approach 5003. A distance 5011 may represent a nominal distance or approximate mean distance between the start 5005 and the end 5007 of the approach 5003.

For an enclosed polygon, it is not necessary that the mobile device 320 (e.g. the vehicle 332) enters or exits the approach 5003 by crossing the start 5005 or the end 5007, respectively. Exceptions may include when a vehicle 332 enters or exits from another side of the approach 5003, such as in a case the vehicle 332 enters the approach from a side street or mid-block driveway, transitions into or out of the approach 5003 from an adjacent lane or path, or performs a U-turn from a lane traveling in an opposite direction and adjacent to the approach 5003.

Approaches may also be defined by virtual borders that are not fully enclosed polygons, such as having at least the start 5005 and/or the end 5007. The other sides such as those that define the approach 5003 as an enclosed polygon are not always necessary as long as a distinction may be made when the vehicle 332 crosses a line, such as the start 5005 or the end 5007, which may extend beyond lengths shown in the diagram, such as across a full width of the road segment. References herein to entering the approach 5003 may also mean passing of the start 5005, regardless of usage of borders or fully enclosed polygons.

In a case the TMS 101 determines the mobile device 320 is located within the approach 5003 (or has passed the start 5005), the TMS 101 may communicate with the DC 504 to send a detection call to the TCD 340, which may then result in the controller 506 adjusting Signal Phase and Timing (SPaT) of the junction 5001 to provide the approaching mobile device 320 with a responsive traffic signal 344, for example, a green light to allow the vehicle 332 to pass with minimal or no interruption, or a red light to slow or stop the vehicle 332.

The TMS 101 may further check direction of travel of the vehicle 332 prior to sending the detection call to the DC 504 or the controller 506. The direction of travel of the vehicle 332 may be determined in a number of ways. In one case one or more locations of the vehicle 332 prior to a present location may be considered by the TMS 101. Time may also be considered to determine an average speed or indicate a rate of progress.

Alternatively, the TMS 101 may consider if the vehicle 332 has passed from one side of a line or demarcation such as the start 5005 or the end 5007 to establish a direction of travel of the vehicle 332 and/or change of a condition.

For example, the TMS 101 or the DC 504 may send a signal to the controller 506 that vehicle traffic from one or more directions of the junction 5001 is approaching the TMS 101 and/or the DC 504 may also consider other conditions prior to sending the signal to the controller 506. Other conditions may also include whether the mobile device 320 was detected to have entered the approach 5003 before or after a predetermined time. Once the signal is received by the controller, the controller 506 may then respond to such input, such as by changing the traffic signal from a red light to a green light in a direction of travel of a vehicle 332 detected by the TMS 101 within the approach 5003, or by extending a time interval of a present green light in the direction of travel of the vehicle 332.

The approach 5003 may be used to detect the vehicle 332 using the mobile device 320 in lieu of or in addition to an existing detection area 459 configured to operate with another, possibly fixed detection device 360 (FIGS. 2A-2D) such as an inductive loop, a video camera, a thermal camera, or a radar system used to detect traffic, that may be located on an approach to the junction 5001.

Figure 3B:
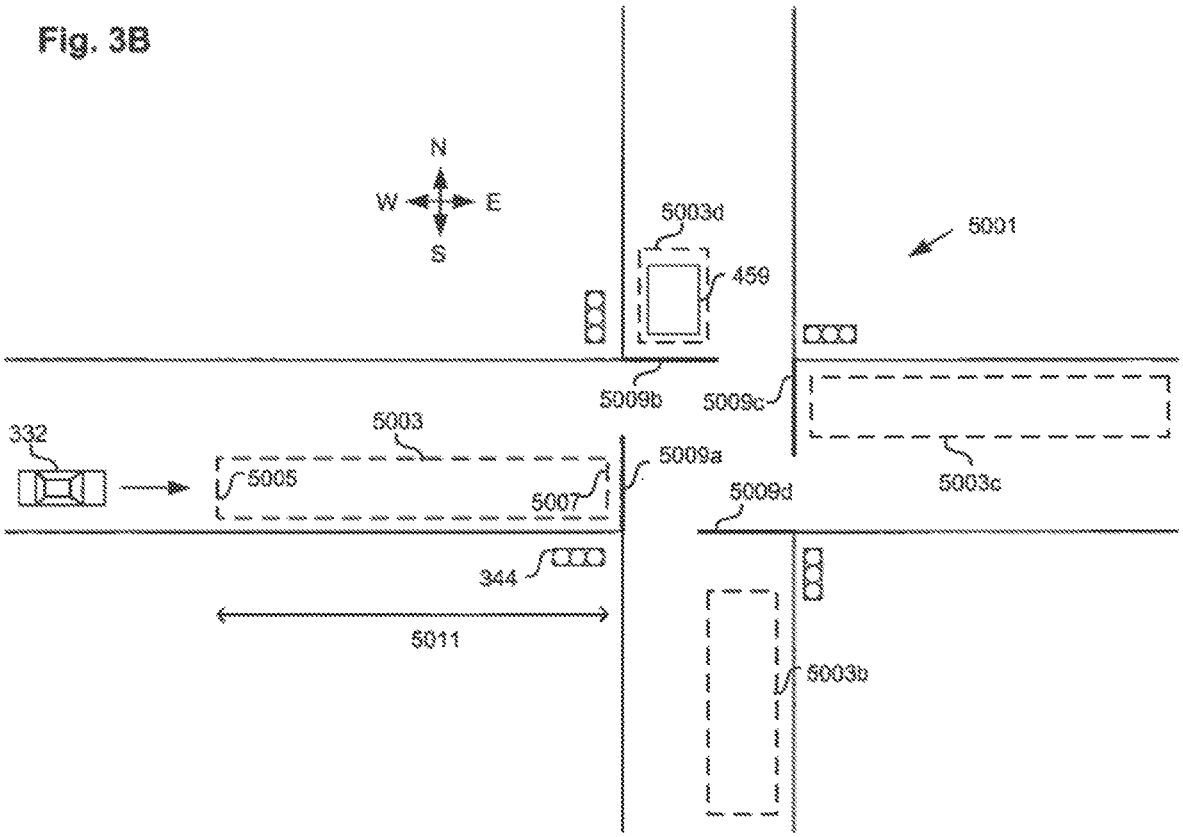
FIG. 3B is a diagram of the junction 5001 with the start 5005 of the approach 5003 located further from the junction 5001 than as described by FIG. 3A, according to one example.

FIG. 3B is a diagram of the junction 5001 with the start 5005 of the approach 5003 located further from the junction 5001 than as described by FIG. 3A, according to one example. The location and area of the approach 5003 may be defined in a way to allow a longer detection period and/or for detection to occur earlier compared with the detection area of a fixed detection system as needed (e.g. the detection area 459), such as by relocating the start 5005 further from the junction 5001 with or without relocating the end 5007 further as well. This may allow the TMS 101 to provide a detection call to the TCD 340 at an earlier time for the vehicle 332 heading toward the junction 5001, increasing a likelihood of the vehicle 332 having a green traffic signal in the direction of travel upon arrival at the junction 5001 and reducing travel time.

In a case the traffic signal 344 is red or yellow in a direction of travel of the vehicle 332 toward the junction 5001, one way to provide a green light to the vehicle 332 upon arrival at the junction 5001, is to determine a location for placement of the start 5005 that may provide a desired traffic signal status of a change to green before the vehicle 332 must slow for the red or yellow signal. The location of the start 5005 may be calculated as an approximate distance 5011 from the junction 5001. The distance 5011 may be such that there is sufficient time as the vehicle 332 travels from the start 5005 to about the junction 5001 to effect the desired traffic signal status. The distance 5011 may be determined based on an actual or anticipated vehicle speed v, for example, a speed limit for a segment of road where the approach 5003 is located, and an estimated total time needed to effect a change in traffic signal status from red to green.

If a route of the vehicle 332 is not known by the TMS 101 in advance then the TMS 101 may use a default approach 5003 on at least one approach to the junction 5001 based on predetermined information not specific to the vehicle 332. Dimensions and placement may be defined by known factors such as a speed limit, a road geometry/topography, and a signal status of one or more junctions. In a case the vehicle 332 enters the approach 5003 then the TMS 101 may take action, such as effecting a detection call to be sent from the DC 504 to the controller 506 of the junction 5001, and may be specific to a particular channel of the controller 506. The channel the detection call is sent on may represent to the controller 506 traffic is approaching from a specific direction of travel through the junction 5001 and which traffic phase is requested or needed, such as a left turn phase, a through phase, and/or a right turn phase.

If a route or position of the vehicle 332 is known or can be estimated by the TMS 101 in advance then the TMS 101 may define dimensions and location of the approach 5003 to the junction 5001 specifically for the vehicle 332, such as based on an actual speed or other characteristic (vehicle class, priority, etc.) of the vehicle 332. The TMS 101 may then effect a detection call to be sent from the DC 504 to a controller 506 of the junction 5001.

More than one approach 5003 (e.g. 5003, 5003', 5003", etc.) may be defined for the same direction approaching the junction 5001 to accommodate more than one mobile device 320, such as in a case multiple vehicles are approaching the junction 5001, with more than one vehicle having at least one mobile device 320 and varying levels of information are available to the TMS 101 about the users, vehicles, and/or status of each user or vehicle equipped with mobile devices. The approaches may overlap and be in use concurrently or sequentially depending on presence of each mobile device 320 being within a corresponding approach 5003.

An estimated total time $t_D$ change or to extend the green light in the direction of travel of the vehicle 332 may be described as $\Sigma t=t_D+t_R+t_C+t_N$, and the distance 5011 of the start 5005 from the junction 5001 may be determined to be about $v(\Sigma t)$ where v is an actual or anticipated speed of the vehicle 332.

A time $t_D$ may be time needed by the TMS 101 to detect the vehicle 332 has entered into the approach 5003 (or pass the start 5005) and then to transmit a response through to the DC 504 for communicating an output to the controller 506. A time $t_R$ may be time needed for the controller 506 to decide when to begin initiating a response such as to extend or change a traffic signal status (including any waiting period, such as to complete a present or other phase before initiating a change in a present traffic signal 344 display, depending on a configuration of the TCD 340 and/or the controller 506).

A time $t_C$ may be time needed to execute the response to change a present status of the traffic signals 344 at the junction 5001 from green in another direction to green in the direction of travel of the vehicle 332, or to extend the green light time in the direction of travel of the vehicle 332. In some cases the time $t_D$ and/or the time $t_R$ may be minimal or approaching zero, depending on system processing power and network communication speed.

The time $t_C$ may have a duration of at least a time a yellow light is displayed as the traffic signal 344 changes from green to red in another direction of travel, to green in the direction of travel of the vehicle 332. This may range from about zero seconds up to about 30 seconds, though is often in the range of about 2 to 15 seconds. To determine the distance 5011 of the approach 5003, the distance 5011 may be equal to at least about the anticipated vehicle speed multiplied by the time $t_C$, and the time $t_C$ may be the time the yellow light is displayed. An additional time margin of up to about 120 seconds may also be included within the time $t_C$ to allow for precautions such as clearance time for cross traffic and/or pedestrian crossings associated with the junction 5001, though the time margin is often more likely in a range of up to about thirty seconds in duration.

A time $t_N$ may be further included in calculating a placement of the start 5005 to provide time to react and slow the vehicle 332 or bring the vehicle 332 to a stop, if needed, such as in a case the traffic signal 344 has remained red or begins to change from green to yellow and/or red as the vehicle 332 approaches the junction 5001.

The time $t_N$ may be estimated to be a sum of a reaction time and a time needed to stop the vehicle 332. For example, human reaction time is known to be at least about 0.20 seconds, though may tend to range up to between 0.50 and 1.0 second for many situations. Stopping time for the vehicle 332 depends on many variables including vehicle speed, vehicle type, vehicle condition, road surface and grade, ambient conditions, and driver awareness and ability for performing a braking maneuver.

Stopping time may be assumed or estimated as an average g force (force of gravity=32.2 ft/s$^2$) over the period of time during braking. In one case, the average g may, for example, be 0.35 the force of gravity. Based on an initial anticipated vehicle speed v of about 40 mph (66 ft/s), braking time may be determined by approximately v/(avg. g)(force of gravity)=66/(0.35)(32.2)=5.86 seconds. Thus $t_N$ may be equal to a sum of braking time and reaction time.

In another case, initial anticipated vehicle speed v may be 50 mph (73.3 ft/s) and an average g may be 0.70 g. Braking time may be determined by approximately 73.3/(0.70)(32.2) 3.25 seconds. Some or all of the amount time $t_N$ may be included in calculations for $\Sigma t$, though not all of the amount may be needed in a case the vehicle 332 does not come to a complete stop and only needs to slow by some proportion before the traffic signals 344 turn green again in the direction of travel. Such may be the case when a vehicle slows then maintains a lower speed before the traffic signal turns green, whereupon the vehicle may continue at the lower speed or begin to accelerate again.

In a case the traffic signal 344 is green in the direction of travel of the vehicle 332 toward the junction 5001 then the start 5005 of the approach 5003 may be located at the same position as in the case that the traffic signal 344 is red or yellow in the direction of travel of the vehicle 332.

In another case, if the traffic signal 344 is presently green in the direction of travel of the vehicle 332, placement of the start 5005 position may be calculated using the equations above with the time $t_C$ as zero, such as if the TCD 340 and/or the controller 506 is configured to be responsive to detection calls to extend the green light in the present phase (direction of travel of vehicle 332), at least until the vehicle 332 is expected to arrive at the junction 5001 such that the vehicle 332 will be able to pass through the junction 5001 during the present phase before the traffic light changes to yellow or red. Further, the time $t_N$ may then also be zero since the vehicle 332 is not expected to change speed as the traffic signal 344 remains green in the vehicle 332 direction of travel, and driver reaction time may not be a factor. Total time may then be expressed as $\Sigma t=t_D+t_R$ and the approximate distance 5011 of the start 5005 from the junction 5001 may be determined to be $v(\Sigma t)$ as previously described above.

For these cases, approximate distances 5011 for positioning the start 5005 from the junction 5001 may range from $v(t_D+t_R)$, which may be about zero, to $v(t_D+t_R+t_C+t_N)$, and may depend upon a present status of the TCD 340 and/or controller 506 of the junction 5001, and whether the traffic signal 344 is red, yellow, or green in the direction of travel of the vehicle 332.

For example, if a speed limit is 30 mph (44 ft/s) where the approach 5003 is located leading to the junction 5001, the traffic signal 344 is presently red in a corresponding direction of travel, and $t_C$ is about 6 seconds, then the respective start 5005 of the approach 5003 may be positioned at least about 264 ft (44 ft/s×6 s) in advance of the junction 5001. Further, if $t_D+t_R$ is known or estimated to be one second then the start 5005 may be positioned at least 308 ft (44 ft/s×7 s) in advance of the junction 5001, compared with if the speed limit is 45 mph (66 ft/s).

If the anticipated vehicle speed is 45 mph in the above situation, then a similar outcome may be accomplished by relocating the start 5005 further from the junction 5001, such that the start 5005 is about (66 ft/s)×(7 s)=462 ft from the junction 5001.

In both of the aforementioned examples, the traffic signal 344 is estimated to turn green as the vehicle 332 arrives at the junction 5001. This leaves no time for braking or other action if the vehicle 332 does not receive a green light some distance prior to the junction 5001 so that the driver may safely respond. The addition of a time $t_N$, as described earlier, allows for inclusion of reaction time of the driver and stopping time for the vehicle 332. The time $t_N$ may be based upon a set of standard values or values specific to a driver and/or vehicle combination.

Positioning the start 5005 at a location further from the junction 5001 allows the TMS 101 and/or the DC 504 to provide a similar response time to send a detection call through to the controller 506 for the detected vehicle 332 that is moving at a higher rate of speed compared to a case the vehicle 332 is moving at a lower rate of speed. This may be due to an increased length (and/or area) of the approach 5003 and increase a time the vehicle 332 is within the approach 5003, and/or maintain a similar time period the vehicle 332 is in the approach 5003 while driving at a higher rate of speed. The distance 5011 of the approach 5003 may be increased by/to 50% to provide an approximately equivalent time period for the vehicle 332 to be in the approach 5003 at 45 mph as would occur in a case the vehicle 332 is traveling at 30 mph. However, a relationship between the distance 5011 and any change in the anticipated vehicle speed (and therefore $t_N$) may be non-linear due to a non-linear relationship of stopping distance as a function of vehicle speed, since stopping distance increases at a higher rate relative to increases in vehicle speed.

Further, if additional time is needed, such as to account for system or communication latency (e.g. $t_D$, $t_R$), the approach 5003 may be lengthened by a distance based on, for example, the speed limit or vehicle speed, and an estimated additional time needed, and then the location of the start 5005 may be effectively relocated by approximately the same distance further from the junction 5001. The end 5007 may remain at a location approximately the same as that of the stop bar 5009, or the end 5007 may also be relocated further from the junction 5001 and closer to the start 5005 (FIG. 3C).

In one case, the end 5007 may be located at or near the stop bar 5009 of the junction 5001. The TMS 101 may repeatedly send a detection signal to the TCD 340 and/or controller 506 through the DC 504 while the vehicle 332 is detected to be in the approach 5003 up to the junction 5001. This may maximize the likelihood that the vehicle 332 is provided with a green light by the time the vehicle 332 arrives at the junction 5001.

The higher a speed limit, anticipated vehicle speed or average speed, the further the start 5005 may be moved from the junction 5001 and/or the longer the distance 5011 of the approach 5003 may be to maintain a time and distance relationship between the vehicle 332 and the junction 5001.

Figure 3C:
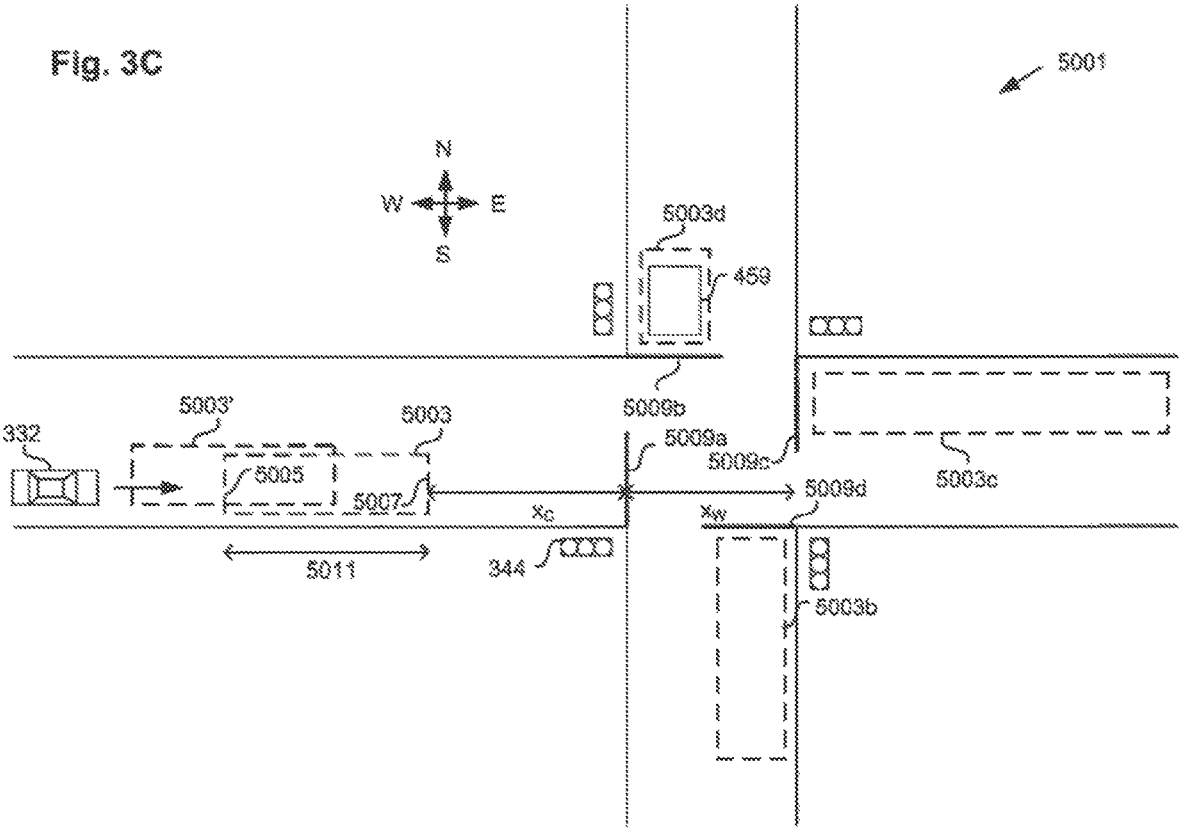
FIG. 3C is a diagram of the junction 5001 where the end 5007 of the approach 5003 may be located further from or closer to the junction 5001 than as described by FIG. 3B, as indicated by a distance $x_C$, according to one example.

FIG. 3C is a diagram of the junction 5001 where the end 5007 of the approach 5003 may be located further from or closer to the junction 5001 than as described by FIG. 3B, as indicated by a distance $x_C$, according to one example.

Locating the end 5007 closer to the junction 5001 may increase a likelihood of the vehicle 332 receiving a green signal in the direction of travel. In a case the DC 504 sends a constant detection call or repeated detection calls to the controller 506 in response to presence of the vehicle 332 in the approach 5003, the closer the end 5007 is located to the junction 5001 the more likely the traffic signal 344 will turn green in the direction of travel of the vehicle 332 before the vehicle 332 arrives at the junction 5001.

Further, if another vehicle also having or functioning as a mobile device 320 is known to be approaching or waiting in the same direction as the vehicle 332 at the junction 5001 then the TMS 101 may relocate the end 5007 of the approach 5003 closer to the junction 5001 to accommodate both vehicles. Alternatively, the TMS 101 may define separate approaches 5003 and 5003', one for each respective vehicle. Either way, the result may be to increase the likelihood of and/or reduce a time until the traffic signal 344 changes to green in the direction of travel of the vehicles. The TMS 101 may also compare vehicle score stack (VSS) or group score stack (GSS) values of identified vehicles or known traffic to determine directional priority if there are one or more vehicles approaching the junction 5001 from more than one direction.

Locating the end 5007 further from the junction 5001 may shorten a time duration between passage of the vehicle 332 through the junction 5001 and a change of the traffic signal 344 from green in the direction of travel of the vehicle 332 to green (and/or a "walk" signal for pedestrians) in another direction, since the TMS 101 may stop sending detection calls for the direction of travel of the vehicle 332 to the TCD 340 and/or the controller 506 and free up other directions of the junction 5001 for green lights sooner.

In one case, an East-West direction of the junction 5001 has a nominal width $x_W$ of 130 feet, and the anticipated vehicle speed is 45 mph (66 f/s). A time $t_W$ for the vehicle 332 to pass through the junction 5001 may be estimated to be about 2 seconds ($t_W$=130 ft/66 f/s). If total change time $\Sigma t$ of the traffic signal 344 is known to be greater than the time $t_W$, for example 6 seconds, then the end 5007 of the approach 5003 may be located up to a maximum distance $x_C$ from the junction 5001 such that the vehicle 332 traveling at 45 mph in that direction would have enough time to reach the end 5007 while the traffic signal 344 in that direction of travel is presently green, pass from the end 5007 through the entire width of the junction $x_W$ before the traffic signal 344 transitions from green to yellow and then red in the direction of travel of the vehicle 332 (presuming the vehicle 332 is traveling in the through direction of the junction 5001 rather than turning right or left in the junction 5001 and the controller 506 is responsive to detection calls of the TMS 101). The vehicle 332 would travel about 315 feet during total change time period. The distance $x_C$ may then be up to about $x_C = v(\Sigma t) - x_W$=(66 ft/s)(6 s)−130 ft 266 ft.

In this case the time $t_N$ of the total change time equation $\Sigma t = t_D + t_R + t_C + t_N$ would be zero since the traffic signal 344 is already green in the direction of travel at the beginning, and the driver is not expected to encounter any change to react to and slow the vehicle 332.

In another case, if a first traffic phase of the junction 5001 is red in the direction of travel of the vehicle 332 as the vehicle 332 approaches the approach 5003, the TMS 101 may send a message to the DC 504 to send one or more detection calls to the controller 506 for another channel associated with a second, non-conflicting traffic phase of the junction 5001 that is presently red (or "Don't Walk). The detection call may change the traffic signal 344 for the second traffic phase direction to green (or "Walk") while allowing the traffic signal 344 in the first traffic phase to also turn green in the direction of travel of the vehicle 332 as the vehicle 332 approaches.

Figure 3D:
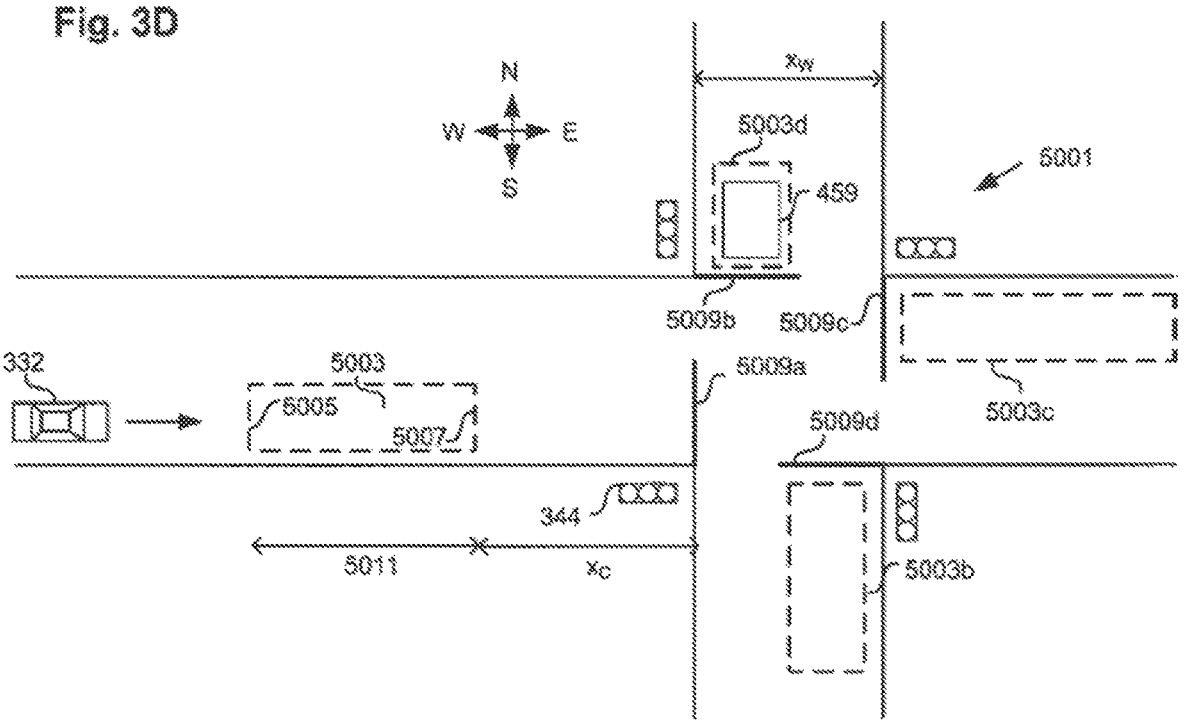
FIG. 3D is a diagram of the junction 5001 with the approach 5003 located a distance $x_C$ from the junction 5001 compared to that described by FIG. 3A, according to one example.

FIG. 3D is a diagram of the junction 5001 with the approach 5003 located a distance $x_C$ from the junction 5001 compared to that described by FIG. 3A, according to one example.

The higher the speed limit or anticipated vehicle speed, the more traffic there is in the direction of travel, or the more time that is needed for the TMS 101 to respond after determining the presence of the vehicle 332 in the approach 5003, the more advantageous it may be to position the approach 5003 further from the junction 5001. The further the distance of the end 5007 from the junction 5001, such as described by FIG. 3C, the less time may be spent between signal phase changes without traffic passing through the junction 5001, depending on the speed limit or anticipated vehicle speed.

In some cases, such as when the vehicle 332 is estimated to arrive at the junction 5001 on green, the start 5005 and the end 5007 may be located further from the junction 5001 due to the higher average speed resulting from the vehicle 332 not having to slow or stop. Relocation of the approach 5003 from the junction 5001, such as by a distance $x_C$ may also be based at least partially upon a green extension time period for the direction of travel through the junction 5001 and the speed limit or anticipated vehicle speed in that direction.

In one case, if the vehicle 332 does not enter the approach 5003 or pass through the end 5007 before the traffic signal 344 is projected to turn yellow, a green time extension call may not be sent by the TMS 101 to the DC 504, which in turn does not send a green extension call to the controller 506. This may result in the vehicle 332 receiving the yellow and then a red signal. Such a scenario may useful for optimizing road usage and traffic throughput across more than one direction of travel through the junction 5001 or other junctions.

In another case, if the vehicle 332 arrives within the approach 5003 or passes through the end 5007 within a time frame, such as while the traffic signal 344 is still green in the direction of travel of the vehicle 332, a green time extension call may be sent by the TMS 101 to the DC 504, which in turn may send a green extension call to the controller 506. Upon doing so the TMS 101 may relocate the end 5007 closer to the junction 5001, either by extending a length of the approach 5003 or moving the approach 5003, and repeating the process for the vehicle 332.

In one case, the end 5007 may be located up to a distance $x_c$ from the junction 5001 that is approximately equal to the product of the anticipated vehicle speed or speed limit, one or more green extension time periods, and a multiple of the number of times the green extension time period may be provided in the present or a subsequent traffic phase.

In one case, the green extension time period may be 1 second, the green phase may be extended up to five times during the present traffic phase, and the anticipated vehicle speed may be 40 mph (58.7 ft/s). So the end 5007 may be moved by at least approximately 58.7 feet (58.7 ft/s×1 s) closer to the junction 5001 with each available green time extension period used during the traffic phase (or a total of up to 5×58.7 feet=293.5 feet during the present traffic phase) to maintain a similar relationship between the location of the end 5007 and movement of the vehicle 332 with respect to the junction 5001 and signal timing as the vehicle 332 approaches the junction 5001.

In another case, the green extension time period may be 3 seconds and the anticipated vehicle speed may be 45 mph (66 ft/s). The end 5007 may be moved at least approximately 198 feet (66 ft/s×3 s) closer to the junction 5001 with each available green time extension period used during the traffic phase to maintain a similar relationship between the location of the end 5007 and movement of the vehicle 332 with respect to the junction 5001 and signal timing as the vehicle 332 approaches the junction 5001.

As the vehicle 332 moves within the approach 5003 the TCD 340 and/or the DC 504 may receive one or more messages from the TMS 101 to extend the green time in the present phase, for example, by the green extension time period by sending one or more detection calls to the controller 506. The process may then be repeated one or more times while the vehicle 332 is in the approach 5003, up to a limit of the number of green time extension periods that may be provided by the controller 506, a limit of the number of detection calls the DC 504 may send to the controller 506, or a limit of an amount of green extension time per phase that may be provided, if such limits are set, or until the end 5007 is expected to be located approximately at the junction 5001 or the stop bar 5009 for the respective direction of the junction 5001.

The TMS 101 may relocate the end 5007 closer to the junction 5001 by a distance approximately equal to the product of the speed limit or the anticipated vehicle speed, and one or more green extension time periods, effectively redefining the area and/or location of the approach 5003 (depending on whether the start 5005 is relocated by about a same distance in the same direction as the end 5007), or the location of and the distance 5011 between the start 5005 and the end 5007.

Relocating or repositioning of the end 5007 may be advantageous in a case each green extension granted by the TCD 340 or controller 506 is known or confirmed, increasing the likelihood that changes to the location of the end 5007 are correlated with green extension time periods, and the approach 5003 continues to be correlated with movement of the vehicle 332.

This may repeat a number of times, for example, until the end 5007 has been relocated from approximately up to a maximum distance $x_C$ from the junction 5001 to somewhere between the maximum distance xc and the junction 5001, until the vehicle 332 otherwise has enough time to clear the junction 5001 with the traffic signal 344 on green (or before the traffic signal 344 has turned red) in the direction of travel, until the vehicle 332 is no longer within the approach 5003, or the vehicle 332 changes course away from the junction 5001, and corresponding detection calls are no longer sent by the DC 504 for the vehicle 332.

If the traffic signal 344 is green in the direction of travel of the vehicle 332, then detection may occur at a later time (and therefore the location of the approach 5003 may be closer to the junction 5001) relative to if the traffic signal 344 is red since the green light time merely needs to be extended enough to allow the vehicle 332 to arrive close to the junction 5001 on green. No time is needed for changing the traffic lights or for the driver to react or slow the vehicle 332 (e.g. $t_C$ and $t_N$ may be zero). Thus a position of the approach 5003 and detection of the vehicle 332 may occur at a closer distance to the junction 5001 or at a time later than in a case that the traffic signal has to be changed from red to green.

During a green extension time period, and for as long as the vehicle 332 is detected to be in the approach 5003, or detected to be in the approach 5003 and moving within a vehicle speed range, detection extension calls may be sent to the TCD 340 and/or the DC 504 by the TMS 101. In some cases at least the end 5007 and/or the start 5005 of the approach 5003 may be relocated in relationship to movement of the vehicle 332 or other traffic, effectively allowing the approach 5003 to follow and encompass the vehicle 332 in real-time or periodically as the vehicle 332 operates within a certain range of speeds and conditions.

Further, the approach 5003 may need a minimum length 5011 to ensure the vehicle 332 is detected within the approach 5003. The length 5011 may be based on detection time $t_D$ and anticipated vehicle speed or speed limit, and may include an added margin.

In one case, the detection time $t_D$ may be 2 seconds and the anticipated vehicle speed may be 60 mph (88 ft/s). The minimum length 5011, without any additional margin, may thus be at least 176 feet (88 ft/s×2 s).

In some cases detection signals may not be sent by the cloud computing environment 300 to the DC 504. These cases may include those where there is higher priority traffic in a cross direction, a detection call is not needed as the traffic signal 344 is already set to green in the direction of travel for a duration that approximately matches the anticipated vehicle speed for the vehicle 332 to clear the junction 5001. Other reasons may include that a present time is outside hours of operation, a user is receiving a penalty for actions related to performing unpredictably, for statistical tracking purposes (such as to establish a control group of data), or other conditional considerations.

In another case, a location and/or area of the approach 5003 may vary dynamically depending upon, for example, at least one of a present speed limit, a time to change a traffic signal 344 from red to green, a traffic signal status in the direction of travel of the vehicle 332, and/or a traffic queue. Relocating the start 5005 further from the junction 5001 allows for signal timing to account for at least one of a higher vehicle speed, a longer traffic queue at the junction 5001, and a longer latency period in computing or communication. A longer approach distance 5011 allows for an earlier or longer detection time period from which the TMS 101 may send one or more detection calls to the DC 504.

Dimensions and usage of the approach 5003 may vary by day of the week, time of day, by changes to the present speed limit, an expected vehicle or traffic speed, by changes in SPaT schedules or plans, in response to crosswalk signal requests, bicycle signal requests, and due to exceptional conditions (accidents, road work, weather, special events, etc.). Further, dimensions and usage may vary for different users or vehicles 332, which may result in more than one approach 5003 being in use concurrently or nearly concurrently when more than one vehicle equipped with a mobile device 320 is operating on or near the same road segment.

Figure 3E:
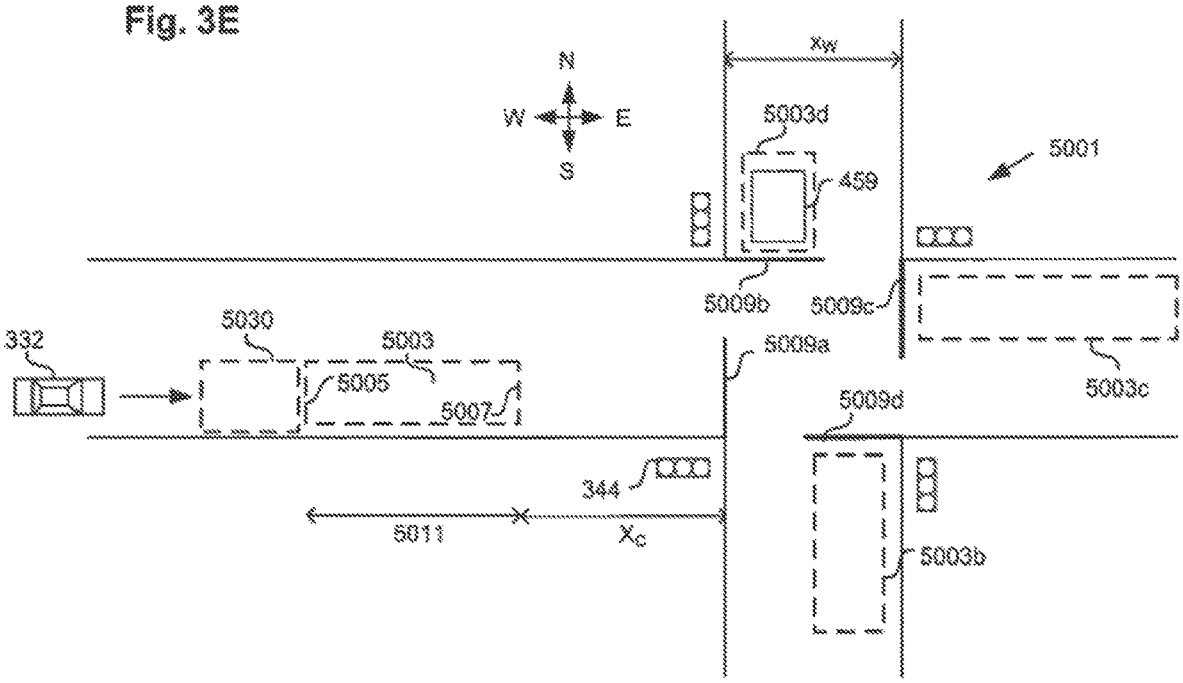
FIG. 3E is a diagram of the junction 5001 with a pre-approach 5030 located before the approach 5003, according to one example.

FIG. 3E is a diagram of the junction 5001 with a pre-approach 5030 located before the approach 5003, according to one example. The pre-approach 5030 may be used to verify direction of travel of the vehicle 332. The pre-approach 5030 may be defined for the approach 5003 and may be located adjacent to or near the approach 5003 such that the vehicle 332 heading toward the junction 5001 would first pass through the pre-approach 5030 prior to entering the approach 5003.

In one case, detection calls for a direction of traffic may be sent by the DC 504 to the controller 506 for the vehicle 332 only if the vehicle 332 has first entered the pre-approach 5030 and then enters the approach 5003. This reduces the likelihood of false positives being sent by either the TMS 101 or the DC 504 about traffic heading toward the junction 5001.

One example of a false positive is a case that traffic heading away from the junction 5001 in an oncoming lane from the approach 5003 is thought to enter the approach 5003, such as due to imprecision in GPS or location detection operation, or imprecision in the defining the area of the approach 5003. Such a case could result in a detection signal being incorrectly sent by the TMS 101 and/or the DC 504 for a vehicle 332 or a mobile device 320 that is not heading toward the junction 5001.

Further, the pre-approach 5030 and/or the approach 5003 in one or more directions of the junction 5001 may be dynamically adjusted or replaced. The locations of the pre-approach 5030 and the approach 5003 may be dependent upon traffic signal status. Depending on a status of the traffic signal 344 at the junction 5001 or another junction, whether it is red or green, the size and placement of the approach 5003 and the pre-approach 5030 may differ, as previously described by FIGS. 3C and 3D. The pre-approach 5030 and the approach 5003 may be adjusted based on user independent factors such as ambient conditions, traffic volume and speed, time of day, the particular characteristics of the junction 5001 (such as elevation, grade, or line of sight of the approaches), and user dependent factors or actions such as vehicle type, mode, or user priority level, may be accounted for with additional information such as that which may predict or more precisely measure vehicle speed or performance or driver reaction time.

In one case, there is an incline after the junction 5001 in the direction of travel of the vehicle 332 where maintaining an expected vehicle speed is advantageous to traffic flow and conserving fuel or energy. In such a case, the TMS 101 may position the approach 5003 further from the junction 5001 and/or increase the length 5011 of the approach 5003 to increase the likelihood the vehicle 332 will receive a green light signal in the direction of travel.

In another case, visibility on the approach to the junction 5001 may be obstructed due to geographical or lighting constraints resulting in lower expected vehicle speed.

In another case, present ambient condition includes rain, snow, or another situation resulting in slippery conditions resulting in lower expected vehicle speed. In such a case, the TMS 101 may position the approach 5003 closer to the junction 5001.

In another case, the vehicle 332 may have a longer than average stopping distance, such as if the vehicle 332 is known by the TMS 101 to be a tractor-trailer, heavy truck, or carrying or towing a payload on the approach to the junction 5001 resulting in a need for a longer stopping distance than other vehicles traveling at a comparable speed.

In some of the cases above, the TMS 101 may position the approach 5003 closer to the junction 5001 to better match lower expected vehicle speed and the likelihood vehicle 332 will receive a green light signal in the direction of travel.

The pre-approach 5030 and the approach 5003 may also be adjusted by the TMS 101 due to factors that are dependent upon a user such as the user's predictability, a VSS and/or a GSS in order to increase or decrease the user's likelihood of receiving a green light in the direction of travel at the junction 5001 commensurately with the user's indicators of predictability.

The foregoing description also makes possible concurrent detection of more than one vehicle 332 approaching the junction 5001 that are within the approach 5003 and/or detection calls to be sent for a longer period of time (the time while at least one vehicle 332 is in the approach 5003) by the TMS 101 through the DC 504 to the controller 506.

In one case, the approach 5003 may serve as the pre-approach 5030 and vice-versa, such as on a road segment having reversible lanes depending on a time of day or day of the week, or if the approach 5003 and the pre-approach 5030 encompass an area that includes lanes in more than one direction of travel.

In another case, the approach 5003 may serve as a pre-approach for a second subsequent approach located on the same road segment in the same direction of travel, or somewhere the vehicle 332 is expected to pass through, such as a location on a known route of the vehicle 332.

Further, a variety of approaches, or pre-approaches and approaches, may be defined for one or more road segments in an area. Such approaches allow for the TMS 101 to identify, confirm or predict a path of one or more users or vehicles to adjust signal timing to match traffic movement in the area during a span of time. The TMS 101 may do so in a way that correlates the likelihood of green lights for users and vehicles with measures and indicators of predictability, for instance the VSS or the GSS of a user, driver, and/or vehicle.

Figure 4:
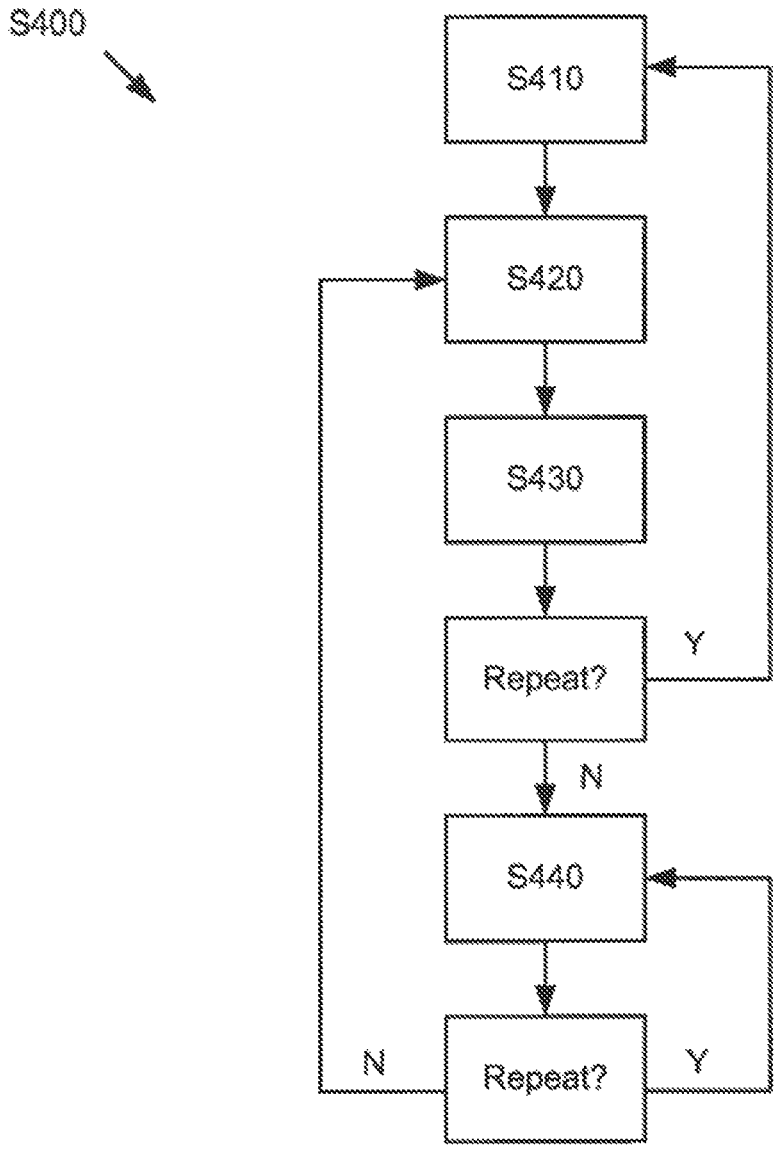
FIG. 4 is a diagram of a process S400 for operating a dynamic virtual traffic detection system, according to one example.

FIG. 4 is a diagram of a process S400 for operating a dynamic virtual traffic detection system, according to one example. The diagram may include a number of primary and secondary processes such as defining approaches S410, detecting traffic S420, comparing criteria S430, and sending detection calls S440.

The defining approaches S410 process may include defining and locating an approach 5003 on a road segment leading to the junction 5001. The approach 5003 may include a start 5005 and an end 5007. The dimensions and location of the approach 5003 may be determined by general values or values specific to the status and characteristics of a mobile device 320 that is, near, or otherwise related to the approach 5003. More than one approach (e.g. 5003, 5003', 5003", etc.) may be defined concurrently or sequentially due to presence and actions of one or more mobile devices 320.

In a case the dimensions and location of the approach 5003 may be defined based upon a particular mobile device 320, such as from available information obtained during the detecting traffic S420 process, the start 5005 and the end of 5007 may be redefined and/or relocated dynamically, such as based on a known present or upcoming signal status of one or more directions or traffic phases at the junction 5001 as described above, to allow detection of presence and movement of the mobile device 320 in particular areas or at particular locations. The process S400 may then proceed to the detecting traffic S420 process.

The detecting traffic S420 process may include identifying presence of one or more mobile devices 320 (e.g. 320, 320', 320", etc.). The detecting traffic S420 process may include identifying a direction of travel and/or an intended direction of travel or route of the mobile device 320, such as may be the case if the mobile device 320 is configured to connect to, communicate with or is otherwise integrated with a navigation system. The detecting traffic S420 process may also include identifying characteristics of a user or a vehicle 332, a present status, and/or historical records that may be associated with the mobile device 320. Alternatively, the detecting traffic S420 process may also include detecting traffic not using a mobile device 320 by using other techniques to obtain data, such as fixed sensor data or a separate data source to identify and/or estimate traffic presence, direction, and/or speed. Such information may be used in lieu of or in addition to that obtained from the mobile device 320. The process S400 may then proceed to the comparing criteria S430 process.

The comparing criteria S430 process may include comparing the status of the mobile device 320 with one or more predetermined criteria such as a speed limit, a traffic volume, an anticipated vehicle speed(s), and priority weightings described herein. Actions may include determining whether the mobile device 320 is presently located within the approach 5003 if the approach 5003 is an enclosed polygon, or between the start 5005 and the end 5007 associated with the approach 5003. The comparing criteria S430 process may also include determining a speed, a direction of travel, or an intended direction of travel of the mobile device 320.

The comparing criteria S430 process may also include comparing the status of a first mobile device with that of a second mobile device. In one case, the mobile device 320 and a second mobile device 320' are located on the same road segment and traveling in a same direction toward the junction 5001. In another case, the first mobile device 320 and the second mobile device 320' are located on different road segments and traveling toward the junction 5001. Status of the first mobile device 320 and the second mobile device 320' may be compared while the mobile devices are in their respective approaches, such as the approach 5003 and a second approach 5003*b*. Status of the first mobile device 320 and the second mobile device 320' may be compared while the mobile devices are in their approaches, such as the approach 5003 and a second approach 5003*b*, respectively. Whether a detection call is sent, and what approach or direction of travel the detection call may be sent for, may depend on the sum of priorities determined in each approach or road segment considered by the TMS 101. The comparing criteria S430 process may also include a process of confirming a sum of priorities of one or more mobile devices detected within one or more approaches of the junction 5001. Priorities may be based on device or vehicle counts, a weighted measure of traffic demand for a particular road segment or approach, or one or more measures of VSS and/or GSS. The process S400 may then proceed to return to the defining approaches S410 process and repeat processes S410 to S430, or proceed to the sending detection calls S440 process.

The sending detection calls S440 process may include the TMS 101 and/or the DC 504 sending a detection call to the controller 506 for a traffic signal 344 in the direction of travel of the mobile device 320 to be green. Alternatively, the sending detection calls S440 process may include sending a detection call for a traffic signal in direction of travel other than that of the mobile device 320 (possibly a conflicting traffic phase or direction of travel at the junction 5001) to be green (or "Walk" signal), which may result in the traffic signal 344 in the direction of travel of the mobile device 320 to turn yellow and then red or to remain red. This may be helpful in slowing or reducing an average speed of the mobile device 320. The process S400 may next proceed to repeat the sending detection calls S440 process or return to the detecting traffic S420 process.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernable variants of the teachings herein, define, in part, the scope of the foregoing claim terminology such that no inventive subject matter is dedicated to the public.

What is claimed:

1. A traffic prioritization system for sending a call signal to a traffic signal controller, the traffic prioritization system comprising:

a receiver configured to receive information sent from a mobile device, the information including at least one of an identity information and a location information;

a traffic control device (TCD) interface configured to connect the traffic prioritization system to the traffic signal controller; and a processor configured to define a dynamic approach that varies in at least one of area and distance from a junction based on at least one of the identity information, a speed limit, a time of day, Signal Phase and Timing (SPaT) data of a junction, a vehicle status information, a priority, and a speed of the mobile device, and further comprising at least one of a Vehicle Score Stack (VSS) of the mobile device, a known route of the mobile device, and an intended route of the mobile device;

determine based on the location information whether the mobile device is in the dynamic approach; and send the call signal to the traffic signal controller via the TCD interface, the call signal being for prompting an action of the traffic signal controller, when the processor determines that the mobile device is in the dynamic approach.

2. The traffic prioritization system as recited in claim 1, wherein the status information includes a status of at least one of a law enforcement vehicle, a fire department vehicle, an emergency medical services vehicle, and an emergency response vehicle operating a non-emergency mode or an emergency mode.

3. The traffic prioritization system as recited in claim 1, wherein the status information includes an operational status of at least one of a passenger vehicle, a motorcycle, a heavy truck, a transit bus, and a for-hire passenger vehicle.

4. The traffic prioritization system as recited in claim 1, wherein the processor determines whether the mobile device is in the dynamic approach as a first determination, wherein the call signal is a first call signal, and wherein the processor is further configured to wait a predetermined amount of time after the first call signal;

determine whether the mobile device is in the dynamic approach as a second determination; and send a second call signal to the traffic signal controller via the TCD interface when the processor determines that the mobile device is still in the dynamic approach area in the second determination.

5. The traffic prioritization system according to claim 4, wherein the processor continues to send call signals at intervals of the predetermined amount of time after the second call signal until the processor determines that the mobile device is no longer in the dynamic approach.

6. The traffic prioritization system as recited in claim 1, wherein the processor determining whether the mobile device is in the dynamic approach is a first determination and the dynamic approach is a first dynamic approach, wherein the mobile device is a first mobile device and the information sent by the first mobile device is first information, wherein the receiver is further configured to receive second information sent from a second mobile device, the second information including at least identity information and location information, wherein the processor is further configured to define a second dynamic approach based on at least one of the identity information of the second information, the speed limit, the time of day, and the speed;

define based on the second location information whether the second mobile device is in the second dynamic approach; and determine a priority, when the first mobile device is in the first dynamic approach and the second mobile device is in the second dynamic approach, the priority being based on the first information and the second information, wherein the call signal the processor sends to the traffic signal controller corresponds to the determined priority.

7. The traffic prioritization system as recited in claim 6, wherein the second mobile device is associated with the individual and the individual is a pedestrian or a bicyclist, and wherein the priority is further determined based on a status of the individual as the pedestrian or the bicyclist.

8. A traffic prioritization system for sending a call signal to a traffic signal controller, the traffic prioritization system comprising:

a traffic detection server configured to receive information sent from a mobile device associated with at least one of a vehicle and an individual, the information including at least identity information and location information;

define a dynamic approach that varies in at least one of area and distance from a junction based on at least one of the identity information, a speed limit, a time of day, and a speed; and further determine based on the location information whether the mobile device is in the dynamic approach; and send a control signal via a network when the processor determines that the mobile device is in the dynamic approach; and a traffic system comprising a receiver configured to receive the control signal sent over the network from the traffic detection server;

a traffic control device (TCD) interface configured to connect the traffic detection device to the traffic signal controller; and a processor configured to send the call signal to the traffic signal controller via the TCD interface, the call signal being for prompting an action of the traffic signal controller, when the control signal is received.

9. The traffic prioritization system as recited in claim 8, wherein the traffic detection server is configured in at least one of a cloud computing, fog computing, and mesh computing environment.

10. A method for operating a dynamic virtual traffic prioritization system comprising:

determining a level of priority of at least one mobile device, the priority of the at least one mobile device based on at least one of the identity information, a speed limit, a time of day, Signal Phase and Timing (SPaT) data of a junction, a vehicle status information, a speed of the mobile device, and further comprising at least one of a Vehicle Score Stack (VSS) of the mobile device, a known route of the at least one mobile device, an intended route of the at least one mobile device;

defining dynamically at least one approach that varies in at least one of area and distance from the junction for at least one road segment of the junction, the at least one approach having at least a start and an end;

detecting a location of the at least one mobile device;

comparing location and direction information of the at least one mobile device with location information of the at least one approach, wherein the at least one approach is the most recently defined at least one approach of the at least one road segment of the junction;

determining the at least one mobile device is located between the start and the end of the at least one approach; and sending at least one detection call to at least one traffic signal controller in a case the at least one mobile device is determined to be located within the at least one approach of the junction.

11. The method of claim 10 further comprising confirming a sum of priorities of the at least one approach of the at least one road segment of the junction is the highest of all sums of priorities of the at least one road segment of the junction based on all mobile devices detected within all approaches of the junction; the sum of priority of each direction determined by a Group Score Stack (GSS).

12. The method of claim 10 wherein the at least one detection call sent to the at least one traffic signal controller is for a traffic phase corresponding to at least one of a present direction of travel of the at least one mobile device and an intended direction of travel of the at least one mobile device.

13. The method of claim 10 wherein the at least one detection call sent to the at least one traffic signal controller is for a traffic phase corresponding to a direction of travel other than that of the at least one mobile device.

14. The method of claim 10 wherein the at least one detection call is based on at least one of a present signal status and a next signal status of the junction.

15. The method of claim 10 wherein the step of determining the at least one mobile device is located between the start and the end of the at least one approach, further comprises determining at least one of a speed of the at least one mobile device, a direction of travel of the at least one mobile device, and an intended direction of travel of the at least one mobile device, before performing the step of sending the at least one detection call to the at least one traffic signal controller.

* * * * *